US005362046A

United States Patent [19]

Sims

[11] Patent Number: 5,362,046

[45] Date of Patent: Nov. 8, 1994

[54] VIBRATION DAMPING

[75] Inventor: Steven C. Sims, Shelton, Wash.

[73] Assignee: Steven C. Sims, Inc., Renton, Wash.

[21] Appl. No.: 62,997

[22] Filed: May 17, 1993

[51] Int. Cl.[5] ..... A63B 49/00

[52] U.S. Cl. ..... 273/73 R; 273/73 J; 273/81 R; 273/67 R

[58] Field of Search ..... 273/73 R, 73 J, 75, 273/81 R, 67 R; 16/110 R; 81/20, 22, 489

[56] References Cited

U.S. PATENT DOCUMENTS 4,811,947 3/1989 Takatsuka et al. ..... 273/73 J 4,936,586 6/1990 Van Raendonck ..... 273/73 J 5,094,453 3/1992 Douglas et al. ..... 273/73 J X

*Primary Examiner*—Vincent Millin

*Assistant Examiner*—Raleigh W. Chiu

*Attorney, Agent, or Firm*—Hughes, Multer & Schacht

[57] ABSTRACT

Small, effective, lightweight, vibration damping devices for implements which are subject to impact. These devices have a head and a stem and are fabricated from a soft elastomeric material. The stem is capable of oscillating over a 360° span in directions generally normal to the longitudinal axis of the device. The peripheral part of the head can oscillate around its circumference in directions generally paralleling that axis.

13 Claims, 6 Drawing Sheets

FIG. 5
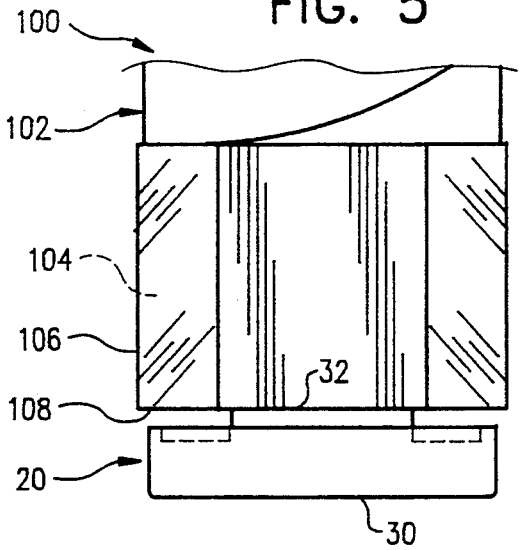
FIG. 6
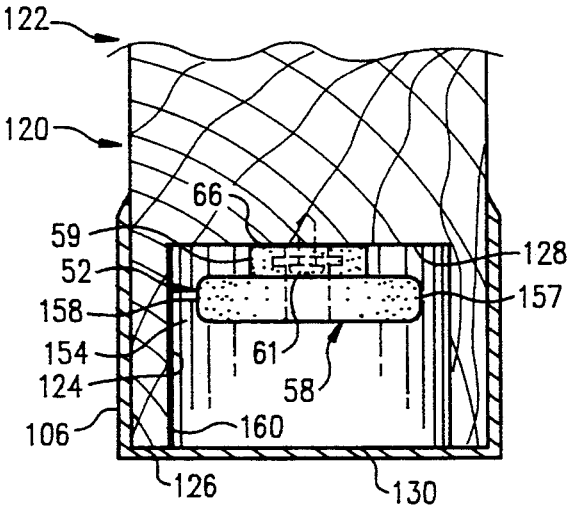
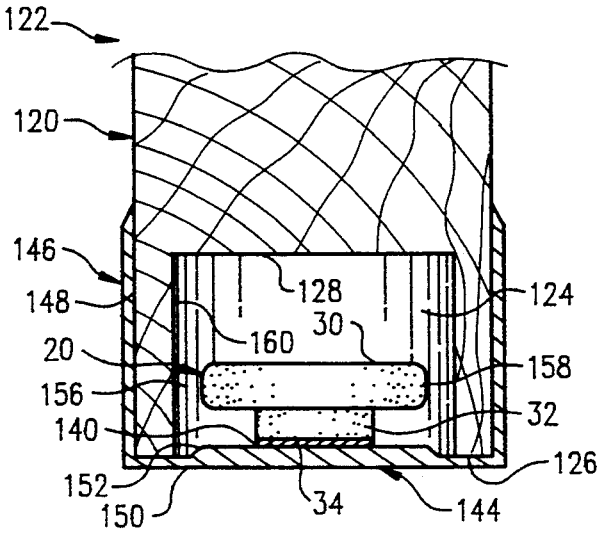
FIG. 7
FIG. 8
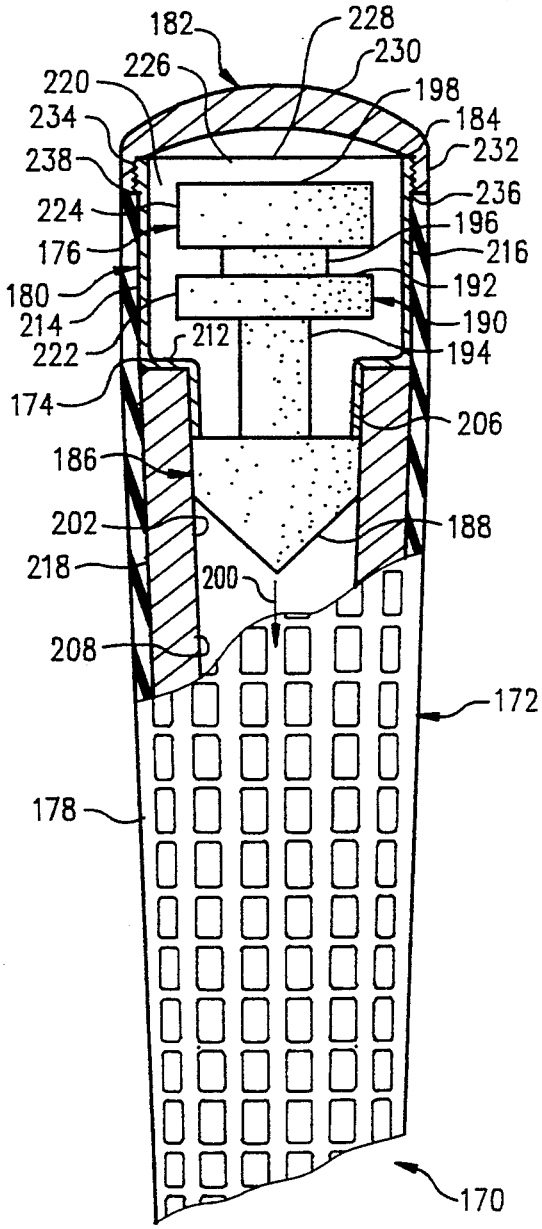

VIBRATION DAMPING

TECHNICAL FIELD OF THE INVENTION

The present invention relates to novel, improved methods and systems for so damping impact-generated vibrations as to keep those vibrations from discomforting or paining the wielder of an implement in which the vibration originated.

DEFINITION

The term "implement" as employed herein is intended to encompass wielded devices designed to impart and receive impacts including but not limited to: golf clubs, baseball and softball bats, tennis rackets, and hammers.

BACKGROUND OF THE INVENTION

It is common for the vibrations set up in an implement by impact to sting the wielder's hands. This stinging can lead to flinching, an altered grip, and other phenomena which adversely affect a player's performance.

The vibrations can also cause serious injury. For example, the stiff graphite and other high tech handles of modern tennis rackets vibrate at high frequencies, and the result is a higher incidence of debilitating tennis elbow.

Others have attempted to solve the problems attributable to impact-generated vibrations with vibration dampers in or attached to the handle of an implement, see U.S. Pat. No. 3,941,380 issued Mar. 2, 1976 to Lacoste. One drawback of this prior art approach is that the feel of the implement upon impact is deader. This dead feel adversely affects the wielder's performance. Another drawback of this prior art approach to offsetting the effect of impact-generated vibrations is that they act too slowly, and the damage is done before the impact is damped.

SUMMARY OF THE INVENTION

There have now been invented and disclosed herein certain new and novel vibration damping systems which have the advantage over those heretofore proposed that they act almost instantaneously and therefore effectively keep unwanted vibrations from being transmitted to the hands of an implement wielder. Instead the energy is advantageously imparted to the object struck by the implement. At the same time, the modus operandi of these novel systems is such that the wielder is unaware of any adverse change in the feel of the implement upon impact.

The novel vibration damping systems of the present invention are fabricated from a soft viscoelastic polymer and have a mushroom-like configuration provided by a head and an integral stem. The vibration damper is attached to or installed in the handle of an implement which can advantageously be subjected to vibration damping. The head and stem of the system are so configured and dimensioned that: (1) the stem can vibrate or oscillate generally normal to the longitudinal axis of the implement handle in any radial direction, and (2) peripheral portions of the damper head can oscillate in directions generally parallel to that axis at any location around the circumference of the damper head.

Vibration dampers employing the principles of the present invention have the advantage that harmful vibrations are damped by the dissipation of energy before they can be transmitted to the wielder of the implement.

This is particularly important when the impact occurs off center or otherwise outside of the sweet spot of the implement as it is impacts in those locations that typically generate the most detrimental vibrations. Or, from another viewpoint, the damping devices disclosed herein have the important advantage that they in effect significantly increase the sweet spot areas of the implements to which they are attached.

The novel vibration damping devices disclosed herein also have the advantage that they effect to only a minimal extent the natural resonance frequencies of the implements with which they are employed. This is important. The dead and other strange, performance affecting feels attributable to the use of damping devices which do have a significant effect on natural resonance frequencies—for example, those disclosed in the above-cited U.S. Pat. No. 3,941,380—are avoided.

Another important advantage of the novel dampers disclosed herein is that they are light and small enough that, even if exposed, they do not interfere with the swing of the implements with which they are associated. The damping devices are simple and relatively easy and inexpensive to manufacture. The devices also have the advantage of being versatile in that they can be used to advantage to dampen deleterious vibrations set up in a wide variety of implements.

The objects, features, and advantages of the invention will be apparent to the reader from the foregoing and the appended claims and as the ensuing detailed description and discussion of the invention proceeds in conjunction with the accompanying claims.

BRIEF DESCRIPTION OF THE DRAWING

FIG. 5 is a view of the butt end of a tennis racket equipped with an energy dissipating device embodying the principles of the present invention;

FIG. 6 and 7 are sections through the butt ends of tennis rackets equipped with two other forms of energy dissipating devices employing the principles of the present invention;

FIG. 8 is a section through the grip end of a golf club equipped with an energy dissipating device embodying the principles of the invention;

DETAILED DESCRIPTION OF THE INVENTION

Figure 1:
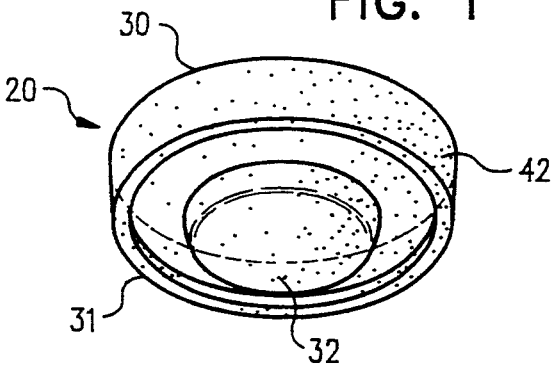
FIG. 1 is a perspective view of an energy dissipating, vibration damping device constructed in accord with and embodying the principles of the present invention.
Figure 2:
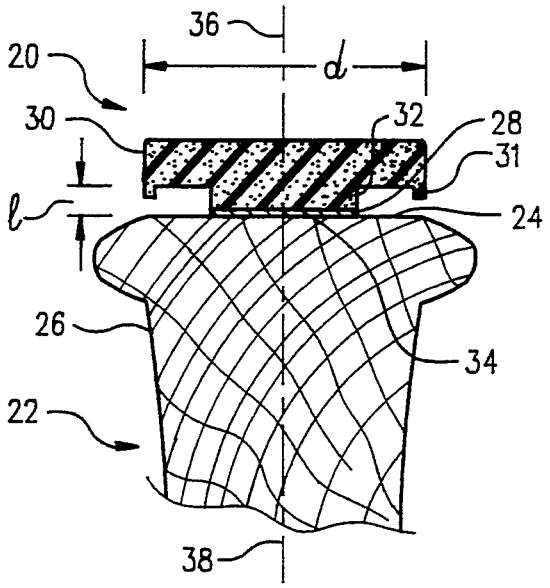
FIG. 2 is a section through the handle end of a wooden bat equipped with an energy dissipating device as illustrated in FIG. 1.

Referring now to the drawings, FIG. 1 depicts a vibration damping device 20 embodying the principles of the present invention; and FIG. 2 depicts a solid, wooden bat 22 of the type used in baseball and softball. This bat is equipped with vibration damping device 20. In this embodiment of the invention, vibration damping device 20 is attached to the exposed end 24 of the bat handle 26 with an appropriate adhesive 28 such as Super Glue or Adcam 728.

Vibration damping device 20 has a mushroom-like configuration and a T-like cross-section defined by a cylindrical head 30 with an annular, depending, peripheral lip 31 and an integral, also cylindrical stem 32. Vibration damping device 20 is assembled to bat handle 26 with the exposed end 34 of stem 32 adjacent and bonded to the exposed end 24 of bat handle 26. The longitudinal centerline 36 of the vibration damping device is coincident with the longitudinal axis 38 of bat 22. Vibration damping device stem 32 consequently extends in the same direction as the bat, and head 30 is oriented normally to longitudinal centerline 36 of the bat.

Vibration damping device 20 is fabricated from a soft, viscoelastic material; i.e., a viscoelastic material with a Shore A hardness in the range of 3 to 20. The preferred elastomer is NAVCOM, a soft, amphorous, rubberlike viscoelastic material available from Vibration Technology Incorporated, Redmond, Wash. NAVCOM contains a mixture of chloroprene and butyl polymers and has the following physical properties:

| | Shore A hardness: 17–90 | | | | |
|---|---|---|---|---|---|
| Environment | Shore A | Ultimate Elongation, (Percent) | Tensile Strength (PSI) | Compression Set (Percent) | Specific Gravity |
| | 7 | 1,075 | 373 | 6.01 | 1.014 |
| | 12 | 900 | 643 | 7.3 | 1.025 |
| | 20 | 835 | 1,069 | 6.9 | 1.063 |
| | 30 | 1,056 | 1,621 | 4.0 | 1.074 |
| | 40 | 326 | 1,453 | N/A | 1.185 |
| | 90 | 175 | 2,440 | N/A | 1.379 |
| Oven aged | 7 | N/A | N/A | 56.3 | — |
| for | 12 | — | — | 31.1 | — |

-continued

| | Shore A hardness: 17–90 | | | | |
|---|---|---|---|---|---|
| Environment | Shore A | Ultimate Elongation, (Percent) | Tensile Strength (PSI) | Compression Set (Percent) | Specific Gravity |
| 70 hrs at | 20 | — | — | 30.8 | — |
| 212 ± 5° F. | 40 | — | — | 22.4 | — |
| | 90 | — | — | 18.6 | — |

| | |
|---|---|
| Resilience: | At room temperature - Medium<br>At high temperature - Fairly high |
| Heat-resistance | Good |
| Outdoor aging resistance: | Excellent |
| Low temp flexibility: | Good |
| Abrasion resistance: | Good |
| Flex life: | Good |
| Solvent resistance: | |
| Hydrocarbons - | Fair to good |
| Oxygenated - | Fair to good |
| Air permeability: | Low to moderate |
| Moisture resistance: | Fair |
| Useful operating temperature: | −40° to 250° F. |

Also important is the ratio between the diameter d of vibration damping device head 30 and the length 1 of the relatively short stem 32. For vibration damping device to function effectively, it is essential that the ratio d:1 be between 5:1 and 1:1.

The illustrated, exemplary vibration damping device 20 is fabricated from the preferred NAVCOM material and has: a head 30 which is 1.6 inch in diameter and 0.25 inch thick, a stem 32 which is 0.178 inch long and 0.5 inch in diameter, and a weight of 4 grams.

The fabricating of vibration damping device 20 from a viscoelastic material with a hardness and the relative proportions specified above produces a device which effectively and rapidly dampens vibrations when bat 22 strikes a ball, particularly if the ball is not struck on the "sweet spot" of the bat and the familiar, stinging sensation is consequently felt. The vibration damping effect is attributable to the dissipation of the energy imparted to bat 22 upon impact by the novel pattern of vibrations thereupon set up in vibration damping device 20 (see FIG. 9).

The stem 32 of vibration damping device 20 can vibrate in directions generally normal to longitudinal axes 36/38 as shown by arrows 40 in any and all directions around the circumference of the stem. At the same time, the peripheral edge portion 42 of vibration damping device stem 30 can vibrate around the circumference of the head in directions generally paralleling axes 36/38 as indicated by arrows 44. This pattern of oscillatory movement is uniquely different from that of prior art vibration dampers such as the pendulum-like devices disclosed in the in the '380 patent and significantly contributes to the superiority of the novel vibration devices of the present invention.

The effectiveness of vibration damping device 20 was confirmed in tests in which bat 22 was suspended and then impacted. Vibrations were detected with a piezoelectric pickup which had a mass of less than two grams and therefore had a negligible effect on the vibrations set up in bat 22. The data acquired by the piezoelectric pickup was processed through a DSP 16 data acquisition system comprising a digital spectrum analyzer and an oscilloscope and employing modified hypersignal software.

Figure 10:
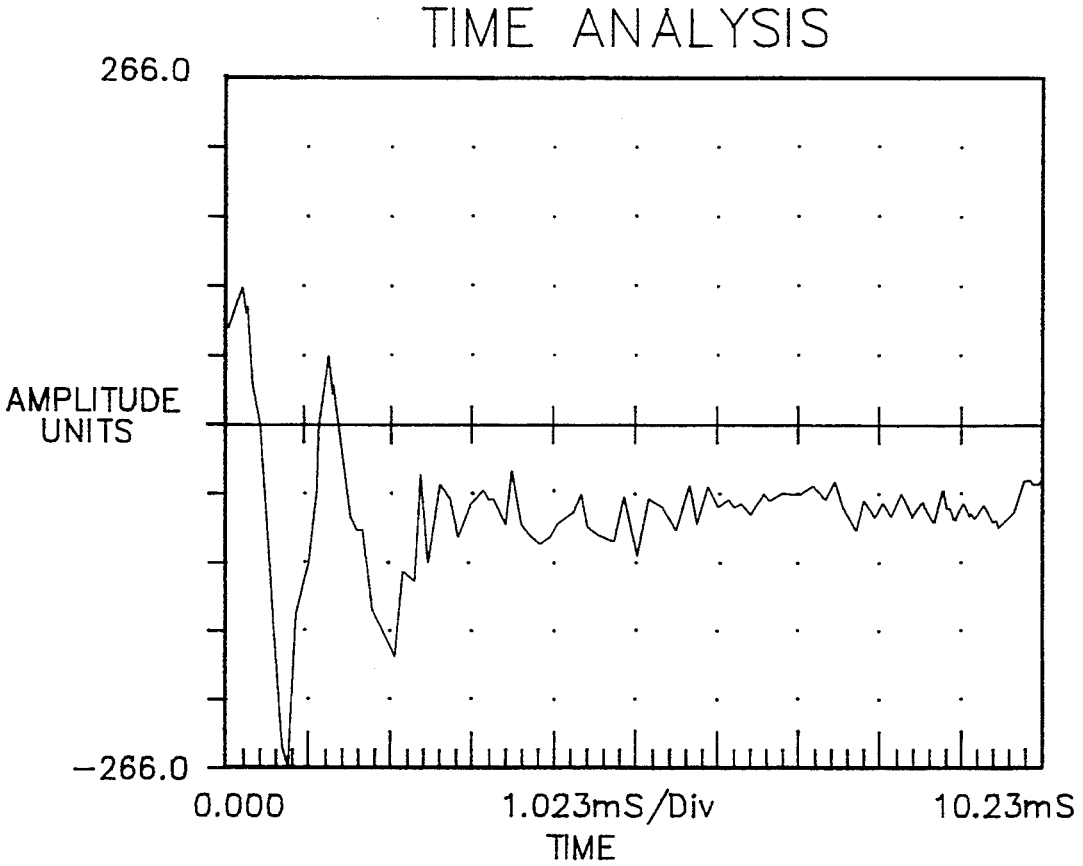
FIG. 10 is a graph showing the decay of vibrations set up in a conventional, wooden bat by an impact on the bat.
Figure 11:
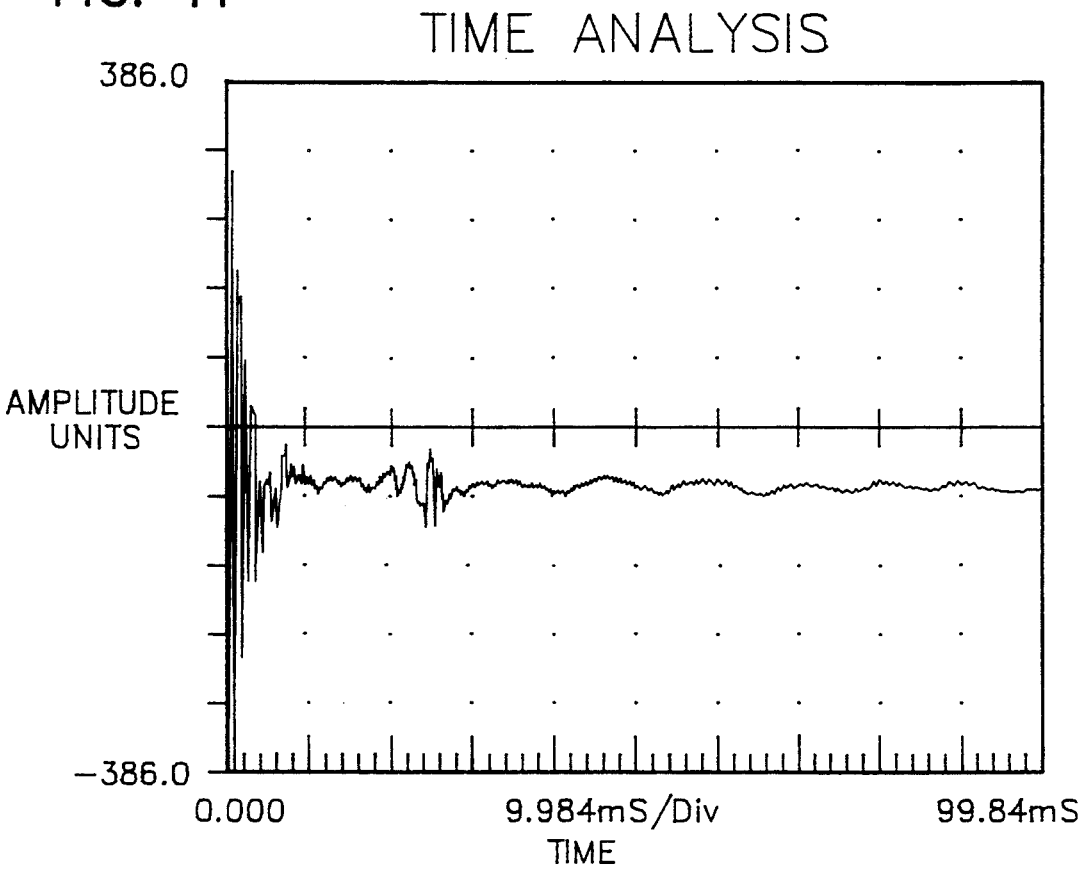
FIG. 11 is a graph of the character presented as FIG. 10 showing the significant and unexpectedly faster rate-of-decay of the impact-generated vibrations set up in a wooden bat equipped with an accessory embodying the principles of the present invention.

FIG. 10 shows that large magnitude vibrations persisted in the undamped bat 22 for a period of 100 milliseconds or longer and that vibrations of significant magnitude were still present after a period of 500 milliseconds. In contrast, the large magnitude vibrations in the bat equipped with vibration damping device 22 were gone after a period of 10 milliseconds, and vibrations of the magnitude remaining in the undamped bat after the 100 millisecond test period had disappeared after approximately 25 milliseconds.

The damping of the large magnitude vibrations in the confirmed 10 millisecond time period is significant. This eliminates the stinging and other unpleasant sensations felt by the user, especially if bat 22 meets a ball outside of the bat's sweet spot. The result is the elimination or at least drastic reduction of the fatigue, flinching, and other movements which make the batter less effective; and of the possibility of injury is minimized. From another viewpoint, vibration damping device 20 has the advantage that it significantly and advantageously increases the area of the bat's sweet spot, again contributing to batting efficiency.

As pointed out above, an unlimited variety of devices or implements subjected to impact may advantageously be equipped with vibration damping devices employing the principles of the present invention. One of these is of course the wooden bat 22 just discussed.

Figure 3:
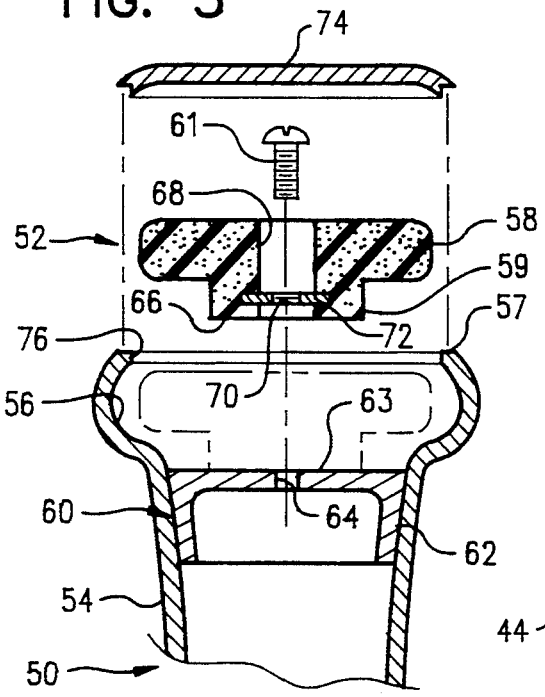
FIG. 3 is an exploded section through the handle end of a hollow bat equipped with a second form of energy dissipating device embodying the principles of the present invention.

Another is the widely used, typically aluminum, hollow bat employed in softball and baseball. FIG. 3 depicts a bat 50 of that character as equipped with a device 52 embodying the principles of the present invention for damping vibrations set up by an impact upon bat 50. The bat shown in FIG. 3 has a hollow handle 54, and vibration damping device 52 is installed in the cavity 56 at the exposed end 57 of the handle.

Vibration damping device 52 is much like the device 20 of the same character discussed above. It is fabricated of a soft, viscoelastic material such as a NAVCOM; and it has a head 58 and stem 59 with a d:l ratio in the range specified above.

In this embodiment of the invention, a fitting 60 is installed in the hollow handle 54 of bat 50; and vibration damping device 52 is fixed to that fitting as by the illustrated screw 61.

Fitting 60 has a trapezoidal section. That section is defined by: (a) a side wall 62 with dimensions and a configuration complementing those of bat handle 54; and (b) a flat, laterally extending, integral support 63 with a centrally located, drilled and tapped, through bore 64. Typically, fitting 60 is press fitted into bat handle 54 and retained in place by friction or dimensioned so that the insert can be retained in place by an appropriate adhesive or in any other suitable manner.

Vibration damping device 52 is installed in the handle end cavity 56 with: (a) the exposed end 66 of stem 59 seated on the laterally extending component 63 of fitting 60, and (b) a central bore 68 through vibration damping device 52 aligned with the threaded aperture 64 in fitting 60. Screw 61 is then displaced through a central opening 70 in a washerlike reinforcement 72 toward the exposed end 66 of vibration damping device stem 59 and threaded through the aperture 64 in fitting 60 to secure vibration damping device 52 in place.

The assembly is completed by attaching a cover 74 to the handle 54 of bat 50 to cover the opening 76 in the exposed end 57 of the bat handle. Threads, an adhesive, friction, or any other appropriate approach may be employed to hold cap 74 in place.

Figure 12:
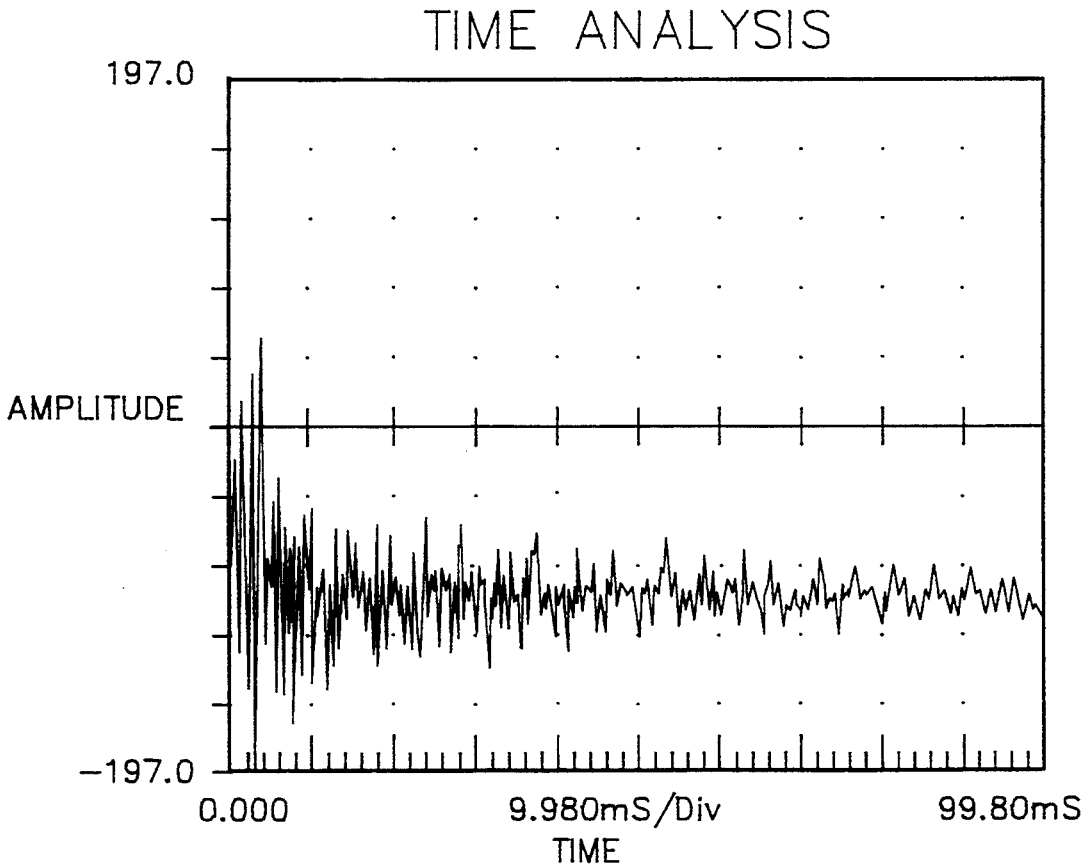
FIG. 12 is a graph showing the decay of vibrations set up in a conventional, hollow aluminum bat by an impact on the bat.
Figure 13:
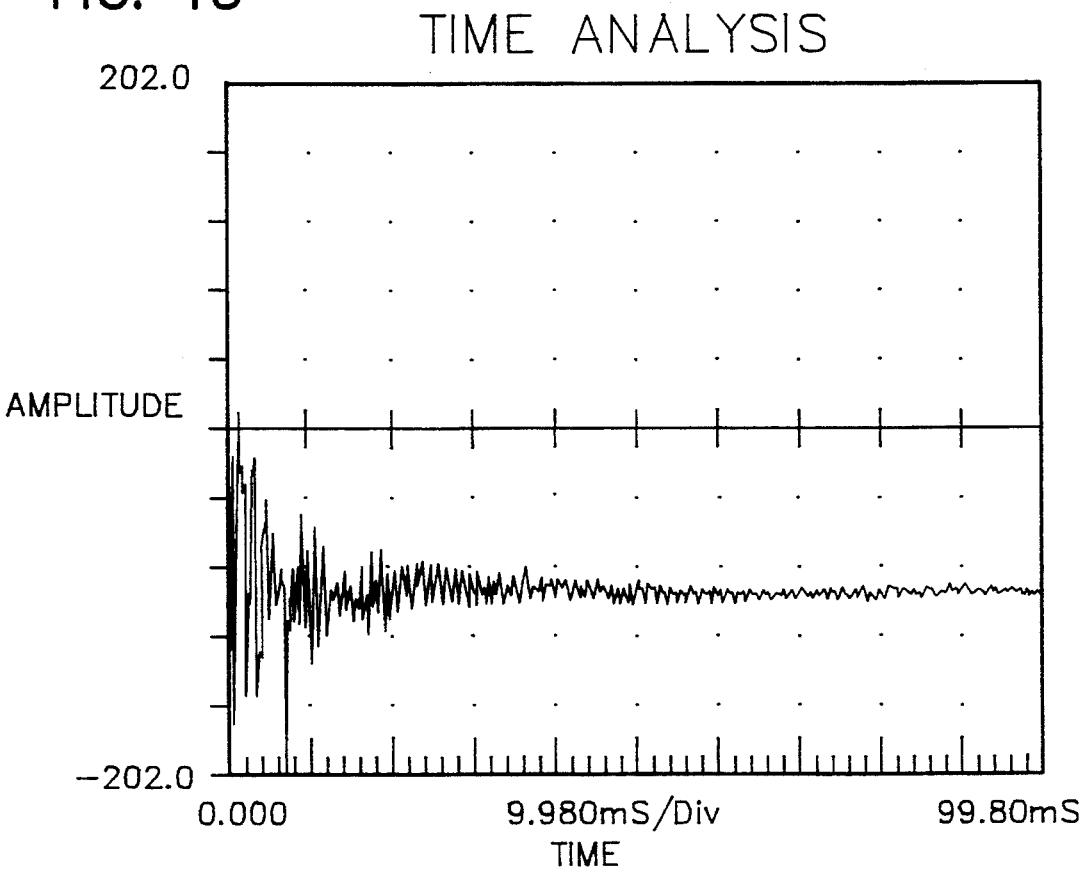
FIG. 13 is a graph of the character presented as FIG. 10 showing the significant and unexpectedly faster rate-of-decay of the impact-generated vibrations set up in a hollow aluminum bat equipped with an accessory embodying the principles of the present invention.

The results of hollow bat time analyses conducted as described above are shown graphically in FIGS. 12 and 13. Larger magnitude vibrations were damped in less than 12 milliseconds in the bat as equipped with the device 52 shown in FIG. 3 whereas they persisted for over three times that long in the undamped bat. Vibrations of significant magnitude persisted over the 100-millisecond duration of the test in the undamped bat but for less than 40 milliseconds in the damper-equipped bat 50. Again, therefore, vibration damping in accord with the principles of the present invention would minimize, if not entirely eliminate, stinging and other unpleasant sensations; reduce fatigue and prevent injury; and make batters more effective by de facto increasing the sweet spot of the bat.

Figure 4:
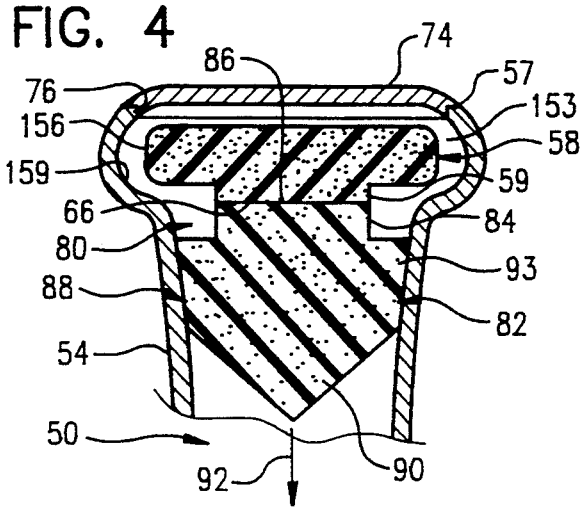
FIG. 4 is a section through the handle end of a hollow bat equipped with a third form of energy dissipating device embodying the principles of the present invention.

An alternative vibration damper for hollow implements such as softball and baseball bats is depicted in FIG. 4 and identified by reference character 80. In this embodiment of the invention, the vibration damping device 80 is configured and dimensioned like the vibration damping device 52 shown in FIG. 3 but without the central aperture formed in the latter. The vibration damping device is bonded with an appropriate adhesive or in any other suitable manner to a spade-sectioned fitting 82. This fitting has a longitudinally extending stem 84 of essentially the same diameter as vibration damping device stem 59, and it is the exposed ends 66 and 86 of the two stems 59 and 84 which are bonded together.

Fitting 82 also has an integral, main body element 88 of circular configuration with a tapered, conical nose section 90. Nose section 90 facilitates the movement of the assembled vibration damper 80 and fitting 82 in the direction indicated by arrow 92 in FIG. 4 to install the vibration damper in the depicted location in the hollow handle 54 of bat 50. Otherwise, fitting 82 has an integral segment 93 which, like side wall 62 of the FIG. 3 fitting 60, is dimensioned and configured for retention in bat handle 54 by friction or an adhesive or in any other desired manner.

Fitting 82 will typically be made of a harder material than vibration damping device 80 so that the latter will vibrate in the patterns discussed above and shown in FIG. 9.

As in the FIG. 3 application of the invention, the opening 76 in the exposed end 57 of bat handle 54 is covered by a cap 74 after the assembly of vibration damping device 80 and fitting 82 is press fitted or otherwise installed in the bat handle.

Referring still to the drawing, FIG. 5 depicts a tennis racket 100 with a handle 102 having an exposed end portion 104 surrounded by a conventional cup-like grip 106 typically fabricated from polyurethane. A vibration damping device of the character discussed above and illustrated in FIG. 2 and identified by the same reference character 20 is adhesively bonded or otherwise fixed to the end surface 108 of grip 106. Device 20 is provided to dampen vibrations set up in handle 102 when racket 100 strikes a tennis ball.

Figure 14:
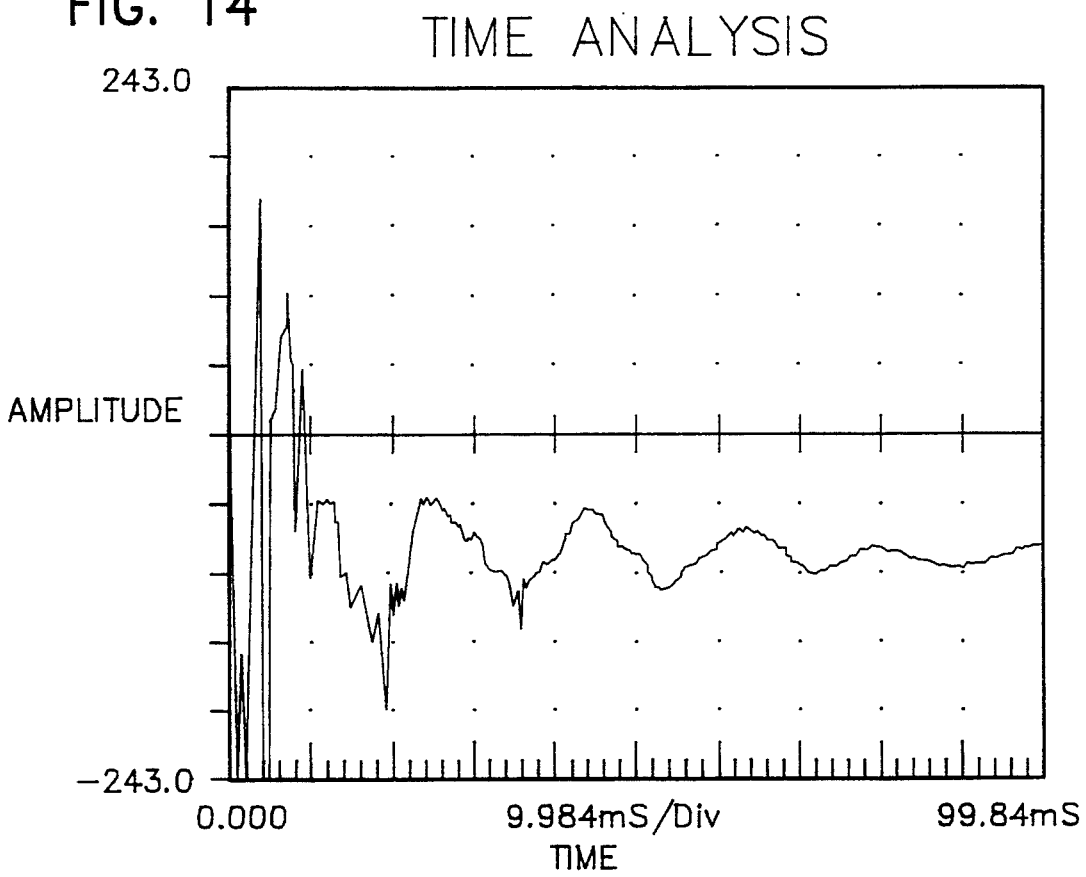
FIG. 14 is a graph showing the decay of vibrations set up in a conventional tennis racket with a graphite handle by an impact on the racket.
Figure 15:
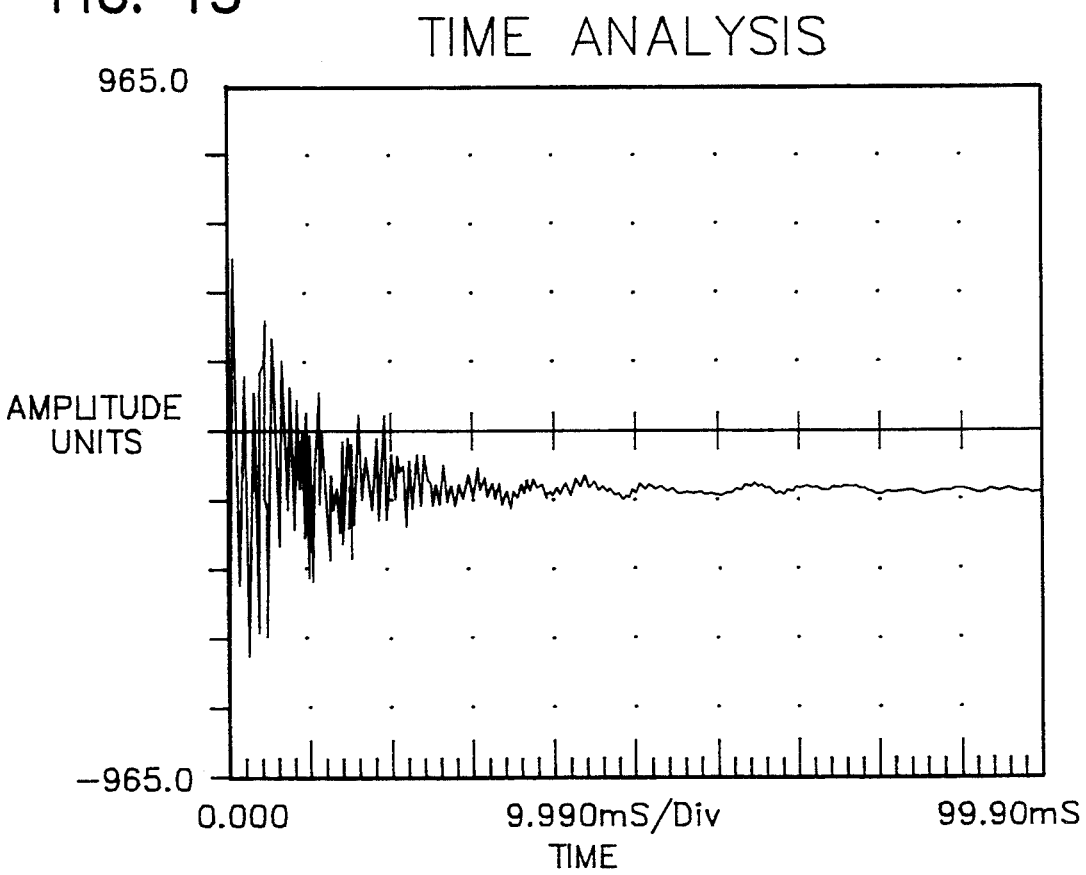
FIG. 15 is a graph of the character presented as FIG. 10 showing the decay of vibrations set up by an impact on a racket of the same type but equipped with a prior art damping device.
Figure 16:
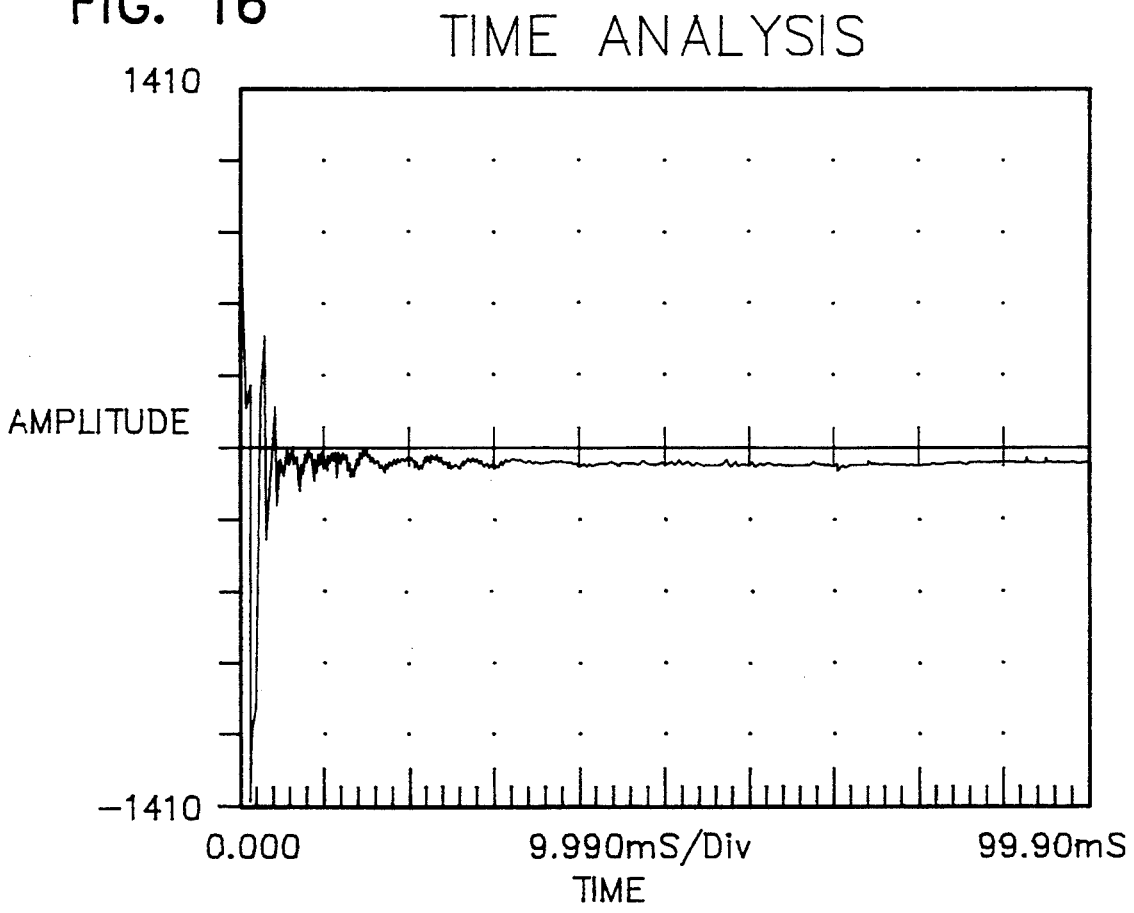
FIG. 16 is a graph like those presented in FIGS. 14 and 15 but showing the significant and unexpectedly faster rate-of-decay of the vibrations set up in a like tennis racket equipped with a vibration damping accessory embodying the principles of the present invention.

FIGS. 14, 15, and 16 show, in graphical form, the results of time analyses of a graphite racket with: (a) no damping device (FIG. 14); (b) a damping device as disclosed in above-discussed U.S. Pat. No. 3,941,380; and (c) damping device 20 adhesively bonded to the exposed end surface 108 of the racket. Both devices proved to have vibration damping capabilities (compare FIGS. 15 and 16 with FIG. 14). However, a comparison of FIGS. 14, 15, and 16 makes it apparent that the damping device 20 employing the principles of the present invention damped large amplitude vibrations in almost one-third of the time required for the prior art damping device to be effective with these large magnitude vibrations being damped in less than 8 milliseconds. This translates directly into major improvements into terms of: elimination of stinging and other unpleasant sensations as well as fatigue, in the prevention of injury, and in improved performance by virtue of the de facto increase in the size of the tennis racket's sweet spot.

FIG. 6 depicts yet another specie of the present invention in which impact-attributable vibrations set up in the handle 120 of a tennis racket 122 are damped with a device embodying the principles of the present invention. The particular damping device utilized in this application of the invention generally duplicates the damping device 52 depicted in FIG. 3.

A longitudinal extending cavity 124 opens onto the exposed end surface 126 of tennis racket handle 120. Vibration damping device 52 is installed in cavity 124 with the exposed end 66 of the damping device stem 59 firmly contacting racket handle 120 at the inner end 128 of the cavity.

In this application of the invention, the screw 61 of the damping device is a conventional wood screw. It is threaded into handle 120 to hold the damping device in place against the tennis racket handle. A grip 106 like that illustrated in FIG. 5 is then installed on the exposed handle end 126 to cover the open end 130 of the damping device-receiving recess 124 and thereby complete the assembly process.

Another, albeit possibly less efficient, arrangement for damping impact-generated vibrations set up in the handle 120 of tennis racket 120 and employing a vibration damper 20 as depicted in FIGS. 1 and 2 is illustrated in FIG. 7. In this case, the vibration damping device is fixed by the illustrated band of adhesive 140 to a relatively rigid, cup-shaped damping device support/-grip 144.

Grip 144 is typically fabricated from a material such as vinyl. It has a side wall segment 146 which surrounds the free or exposed end segment 148 of racket handle 120. It also has an integral, laterally extending segment 150 which spans the open end 130 of cavity 124 and has a central pedestal 152. As shown in FIG. 7, adhesive 140 fastens the exposed end 34 of vibration damping device stem 32 to pedestal 152 with the head 30 of the vibration damping device facing the inner end 128 of cavity 124.

Referring now to FIGS. 4, 6, and 7, it is important that there be a clearance gap 153 (FIG. 4), 154 (FIG. 6), or 155 (FIG. 7) between the periphery 156 (FIG. 4), 157 (FIG. 6), or 158 (FIG. 7) of the vibration damping device head 58 or 30 and the side 159 or 160 of the cavity 56 or 124 in which the vibration damping device is installed. It is also essential that this gap extend around the entire circumference of the damping device head. This is required so that the stem of the involved damping device can oscillate or move in the arrow 40 directions (see FIG. 9) and so that the marginal portions of the damping device heads can oscillate in the arrow 44 directions. Both patterns of movement are required for the damping devices to function effectively.

The golf club 170 depicted in FIG. 8 is another implement which can advantageously be equipped with a device employing the principles of the present invention to rapidly dampen large magnitude vibrations with the significant and advantageous results discussed above. Golf club 170 has a conventional, hollow handle 172. The vibration damping device installed in this handle at its exposed or free end 174 is identified by reference character 176. Other major components of the vibration damper-equipped golf club 170 include a conventional grip 178, a grip support 180 which also surrounds and houses vibration damping device 176, and an internally threaded cap or cover 182 at the exposed end 184 of the grip support.

The vibration damper 176 illustrated in FIG. 8 resembles the vibration damper/support assembly 80/82 depicted in FIG. 4. It has: (a) a handle gripping damper support 186 with a tapered or pointed, installation-facilitating nose 188; and (b) an integral damper 190 of mushroom-like configuration. The damper part of the device has a circular head 192 and a stem 194. In the illustrated embodiment of the invention, stem 194 replaces the two separate stems 59 and 84 of the damper/-support system shown in FIG. 4.

The integral damper component 190 also has a second, stem 196 longitudinally aligned with stem 194. Stem 196 is capped by a second, laterally extending, circular head 198 disposed in spaced, parallel relationship to head 192. Stems 194 and 196 are both dimensioned and configured for oscillation in the arrow 40 directions (see FIG. 9). Vibration damper heads 192 and 198 are dimensioned and configured for oscillation in the arrow 44 directions. This provision of multiple, oscillatable heads and stems makes vibration damper component 190 particularly efficient and effective.

Vibration damper device 176 is assembled to the hollow shaft 172 of golf club 170 by displacing it in the arrow 200 direction. This displacement is continued until support component 186 is seated in the bore 202 through shaft 172 in longitudinally spaced relationship to the exposed end 174 of the shaft with the heads 192 and 198 of the vibration damper component 190 located beyond that shaft end. As discussed in conjunction with the FIG. 4 embodiment of the invention, friction, an adhesive, or any other appropriate mechanism can be employed to retain support component 186 in place.

The assembling of the vibration damper device 176 to the hollow golf club shaft 172 is followed by the installation of grip support 180. This component, which is fabricated of a relatively stiff material such as sheet steel or nylong, has a necked down segment 206 configured and dimensioned to complement the inner surface 208 of the bore 202 through golf club shaft 172. Grip support 180 also has: (a) an integral, laterally extending flange segment 212 which abuts the outer end 174 of golf club shaft 172; and (b) a second, also longitudinally extending and integral, damper housing segment 214 which protrudes beyond the exposed end 174 of the golf club shaft. Integral segment 214 has an outer diameter matching that of the golf club shaft 172, the outer surface 216 of segment 214 consequently constituting an extension of the outer surface 218 of the shaft. This like diameter extension of hollow shaft 172 afforded by the segment 214 of grip support 180 allows grip 178 to transition smoothly from the shaft to the grip support, making the grip "feel right" to the golfer.

Figure 9:
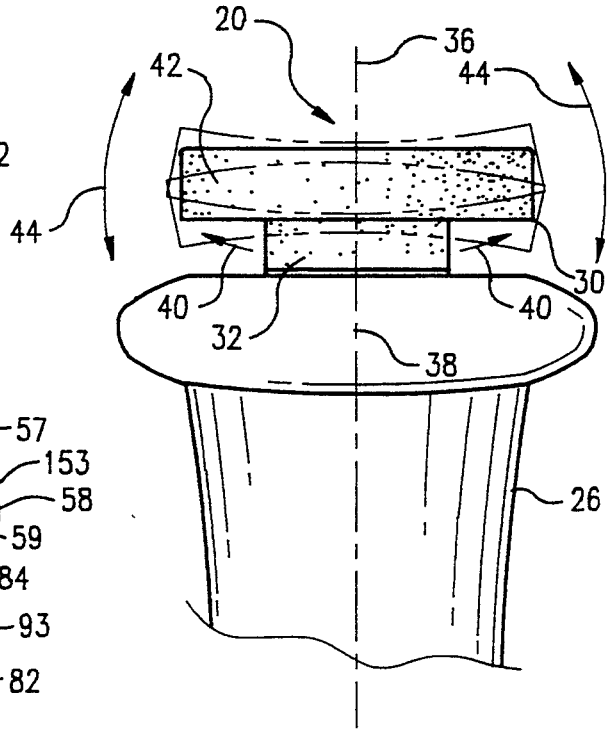
FIG. 9 is a view showing the movements made by a device as depicted in FIG. 1 in the course of dissipating energy imparted to a bat equipped with the device.

As in the FIGS. 4, 6, and 7 embodiments of the invention, an annular gap 220 is provided between the peripheries 222 and 224 of damping device heads 192 and 198 and the inner, cylindrical surface 226 of support segment 214. This accommodates the FIG. 9 depicted patterns of oscillation of the heads and damping component stems 194 and 196.

The assembly process is completed by the installation of cover 182 over the exposed, open end 228 of grip support segment 214. The illustrated, exemplary cover 182 has a laterally extending, domed segment 230 and an internally threaded, cylindrical side wall segment 232. Cover 182 is screwed onto the externally threaded, free end segment 234 of grip support segment 214 until the exposed end 236 of cover side wall 232 reaches the exposed end 238 of grip 178 and the domed segment 230 of the cap is seated on the exposed end 184 of the grip support segment 214.

The invention may be embodied in many forms without departing from the spirit or essential characteristics of the invention. For example, devices with even more than two stems and heads can be employed; and it is not necessary that the device be located at the end of the implement handle. The present embodiments are therefore to be considered in all respects as illustrative and not restrictive. The scope of the invention is indicated by the appended claims rather than by the foregoing description. All changes which come within the meaning and range of equivalency of the claims are intended to be embraced therein.

What is claimed is:

1. The combination of an implement and an accessory which keeps deleterious, impact-generated vibrations from being transmitted to a wielder of the implement, said accessory being fabricated from an elastomer and having a mushroom-like configuration defined by a stem and an integral head, said stem being fixed to said implement and being configured for vibration free of contact with said implement in directions which encompass a 360° arc and are generally normal to the longitudinal axis of the accessory, and said head being dimensioned and configured for implement-free vibrational bending of its peripheral edge at all loci around the circumference thereof in first and second, opposite directions generally paralleling the longitudinal axis of the accessory.

2. A combination as defined in claim 1 in which the ratio of head width to stem length is in the range of 5:1 to 1:1.

3. A combination as defined in claim 1 in which the Shore A hardness of the elastomer from which the damper means is fabricated is in the range of 3 to 20.

4. A combination as defined in claim 1 in which the elastomer from which the damper means is fabricated comprises an amorphous mixture of butyl and chloroprene polymers.

5. A combination as defined in claim 1 in which the implement has a handle and the combination includes fastener means for attaching said damper means to said handle.

6. A combination as defined in claim 5 in which the implement has a handle with an exposed end, there is a cavity in said exposed end of said handle, said damper means is located in said cavity, and there is sufficient clearance between the head of the damper means and the wall of the cavity that the damper means does not touch said wall during impact-effected displacement of said damper means.

7. A combination as defined in claim 1 in which said implement has a handle and the combination includes an adhesive for attaching said damper means to said handle.

8. A combination as defined in claim 1 in which the damper means is so constructed and fabricated as to decrease the rate-of-decay of vibrations set up in the implement by the impact.

9. A combination as defined in claim 1 in which the implement has a component adapted to strike a game object and a handle and the damper means is located at an exposed end of said handle.

10. A combination as defined in claim 9 in which the damper means is located exteriorly of and attached to the handle.

11. A combination as defined in claim 9 in which the damper is installed in said handle.

12. The combination of an implement and an accessory which keeps deleterious, impact-generated vibrations from being transmitted to a wielder of the implement:

said accessory being fabricated from an elastomer and having a mushroom-like configuration defined by a stem and an integral head;

said stem being fixed to said implement and being configured for vibration in directions which encompass a 360° arc and are generally normal to the longitudinal axis of the accessory;

said head being free of said implement and configured for vibration of its peripheral edge around the circumference thereof in first and second directions generally paralleling the longitudinal axis of the accessory;

said implement having a component adapted to strike a game object and a handle, the accessory being installed in and protruding from an exposed end of said handle;

and said implement comprising a grip which surrounds said handle and a protruding part of the accessory and a cover which cooperates with said grip to envelope the accessory.

13. A combination as defined in claim 12 in which the implement comprises a grip support fixed to the exposed end of the handle inside of and in abutting relationship with that part of the grip protruding beyond the handle.

* * * * *

US005362046C1

(12) EX PARTE REEXAMINATION CERTIFICATE (9234th)

United States Patent
Sims

(10) Number: US 5,362,046 C1
(45) Certificate Issued: Aug. 28, 2012

(54) VIBRATION DAMPING

(75) Inventor: Steven C. Sims, Shelton, WA (US)

(73) Assignee: Sims Vibration Laboratory, Inc., Shelton, WA (US)

Reexamination Request:
No. 90/009,917, Jul. 10, 2011

Reexamination Certificate for:

| | |
|---|---|
| Patent No.: | **5,362,046** |
| Issued: | **Nov. 8, 1994** |
| Appl. No.: | **08/062,997** |
| Filed: | **May 17, 1993** |

(51) Int. Cl.
*A63B 49/00* (2006.01)

(52) U.S. Cl. ..... 473/300; 473/318; 473/523

(58) Field of Classification Search ..... 473/300, 473/318, 523, 520
See application file for complete search history.

(56) References Cited

To view the complete listing of prior art documents cited during the proceeding for Reexamination Control Number 90/009,917, please refer to the USPTO's public Patent Application Information Retrieval (PAIR) system under the Display References tab.

*Primary Examiner*—Matthew C. Graham

(57) ABSTRACT

Small, effective, lightweight, vibration damping devices for implements which are subject to impact. These devices have a head and a stem and are fabricated from a soft elastomeric material. The stem is capable of oscillating over a 360° span in directions generally normal to the longitudinal axis of the device. The peripheral part of the head can oscillate around its circumference in directions generally paralleling that axis.

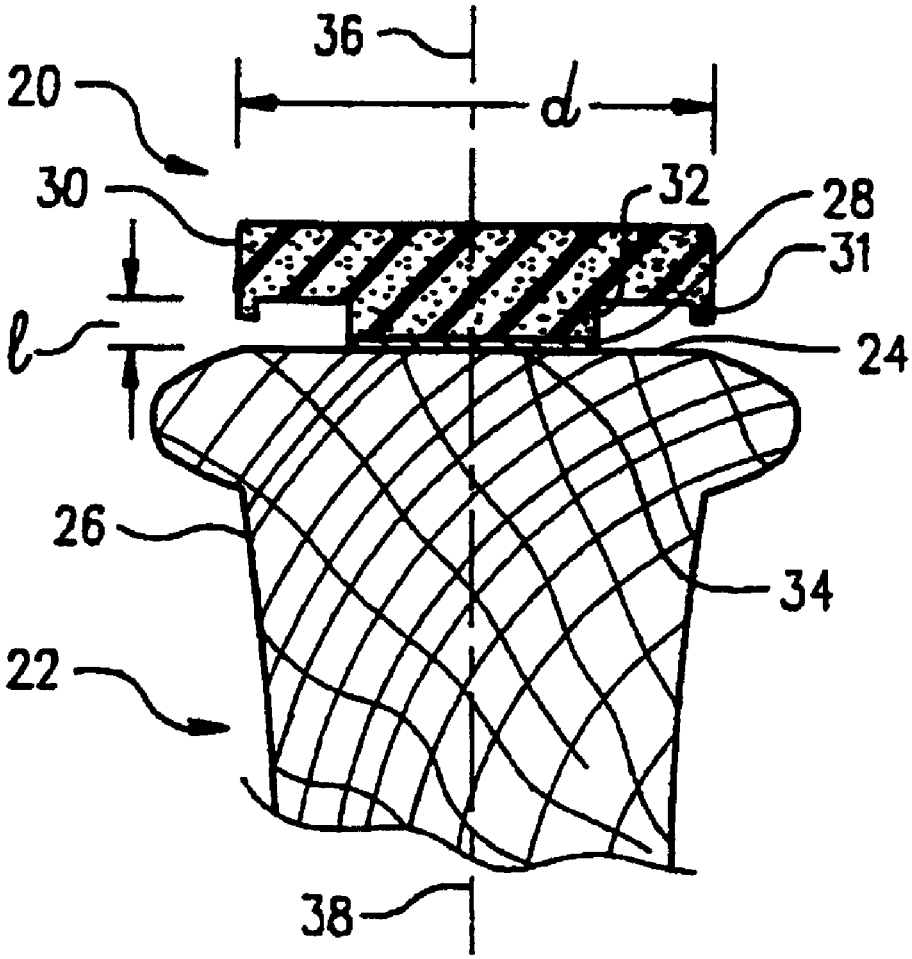

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 4-12 is confirmed.

Claims 2, 3 and 13 were not reexamined.

* * * * *